US007032386B2

(12) United States Patent
Mandai et al.

(10) Patent No.: US 7,032,386 B2
(45) Date of Patent: Apr. 25, 2006

(54) GAS TURBINE COMBUSTOR

(75) Inventors: Shigemi Mandai, Hyogo (JP); Katsunori Tanaka, Hyogo (JP); Masahito Kataoka, Hyogo (JP); Keijirou Saitoh, Hyogo (JP); Wataru Akizuki, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 133 days.

(21) Appl. No.: 10/416,515

(22) PCT Filed: Jun. 25, 2002

(86) PCT No.: PCT/JP02/06318

§ 371 (c)(1),
(2), (4) Date: Dec. 1, 2003

(87) PCT Pub. No.: WO03/002913

PCT Pub. Date: Jan. 9, 2003

(65) Prior Publication Data

US 2004/0074236 A1 Apr. 22, 2004

(30) Foreign Application Priority Data

Jun. 27, 2001 (JP) ..... 2001-195310

(51) Int. Cl.
*F02C 1/00* (2006.01)
*F23R 3/06* (2006.01)

(52) U.S. Cl. ..... 60/757

(58) Field of Classification Search ..... 60/748, 60/757

See application file for complete search history.

(56) References Cited

U.S. PATENT DOCUMENTS

| | | | | |
|---|---|---|---|---|
| 2,664,702 | A * | 1/1954 | Lloyd et al. | 60/754 |
| 2,860,483 | A * | 11/1958 | Fox | 60/757 |
| 3,359,724 | A | 12/1967 | Barnwell et al. | |
| 3,854,285 | A * | 12/1974 | Stenger et al. | 60/757 |
| 5,239,831 | A * | 8/1993 | Kuroda et al. | 60/737 |
| 5,479,772 | A * | 1/1996 | Halila | 60/757 |
| 5,836,164 | A * | 11/1998 | Tsukahara et al. | 60/748 |
| 6,105,372 | A | 8/2000 | Mandai et al. | |

FOREIGN PATENT DOCUMENTS

| | | |
|---|---|---|
| EP | 1001224 | 5/2000 |
| GB | 2 134 243 A | 8/1984 |
| JP | 8-285284 | 11/1996 |

* cited by examiner

*Primary Examiner*—Ted Kim
(74) *Attorney, Agent, or Firm*—Oblon, Spivak, McClelland, Maier & Neustadt, P.C.

(57) ABSTRACT

A combustor for a gas turbine has an arrangement to form a layer of cooling-air on an inner surface of a liner of a combustion chamber. This layer of the cooling air extends from a fuel nozzle block of the combustor toward a downstream side with respect to the liner.

2 Claims, 13 Drawing Sheets

(a)

(b)

(a)

(b)

GAS TURBINE COMBUSTOR

TECHNICAL FIELD

The present invention relates to a combustor for a gas turbine, and more specifically, relates to a combustor that can stably cool its walls, regardless of the operation time and operation condition.

BACKGROUND ART

A premixed combustion method is used in the present day combustors a from a standpoint of environmental protection, because, the premixed combustion method achieves a reduction of thermal NOx. The premixed combustion method includes premixing a fuel and excessive air and burning the fuel. In the premixed combustion method it is possible to easily reduce NOx, because the fuel burns under a lean condition in all areas in the combustor. The premixing combustor that employs the premixed combustion method is explained below.

FIG. 13 is a cross-sectional view of the premixing combustor. A pilot cone 610 for forming diffusion flame is provided in a casing 700 of a combustor nozzle block. A fuel nozzle block 29 is fitted to the outlet of the combustor nozzle block casing 700, and this fuel nozzle block 29 is inserted in the liner 19 of a combustion chamber. The pilot cone 610 forms the diffusion flame by allowing a pilot fuel supplied from a pilot fuel supply nozzle (not shown) to react with combustion air supplied from a compressor.

Eight premixed flame forming nozzles 510 are provided around the pilot cone 610 although only one premixed flame forming nozzles 510 is seen in FIG. 13. The premixed gas is produced by mixing combustion air and a main fuel, and is injected from the premixed flame forming nozzles 510 toward the combustor. The premixed gas injected from the premixed flame forming nozzles 510 to the combustor is ignited by a high temperature combustion gas exhausted from the diffusion flame, to thereby form premixed gas combustion flame. High temperature and high pressure combustion gas is exhausted from the premixed gas flame, and the combustion gas is guided to a first stage nozzle of a turbine, through a combustor tail pipe (not shown).

When sudden combustion occurs near the wall surface of the liner of the combustion chamber, oscillating combustion occurs. Conventionally, there is a problem in that combustion becomes unstable due to the oscillating combustion, and hence stable operation cannot be carried out. Further, there is another problem in that when combustion occurs near the wall surface of the liner of the combustion chamber, the liner of the combustion chamber is overheated, thereby shortening the life thereof. When the life of the liner of the combustion chamber becomes short, repair and replacement are required frequently, and hence time and energy are required for maintenance.

It is an object of the present invention to solve at least the problems in the conventional technology.

DISCLOSURE OF THE INVENTION

The combustor according to one aspect of the present invention includes an arrangement to form a cooling-air layer toward the downstream of the liner of a combustion chamber, on the inner surface of the liner of the combustion chamber, immediately after a fuel nozzle block of the combustor.

In the above-mentioned combustor, since the cooling-air layer is formed on the inner surface of the liner of the combustion chamber immediately after the fuel nozzle block, where the concentration of the premixed gas is high, combustion near the wall surface in this portion can be suppressed. Therefore, oscillating combustion can be suppressed, and the liner of the combustion chamber can be protected from the high temperature combustion gas. The cooling-air layer may be formed on the inner surface of the liner of the combustion chamber by cooling steam, instead of using the cooling air fed from the compressor (same thing applies hereafter). Since the steam has a higher cooling efficiency than air, combustion on the inner surface of the liner of the combustion chamber can be further suppressed. As a result, the oscillating combustion can be reliably suppressed than the case of using the air.

The combustor according to another aspect of the present invention includes a fuel nozzle block that is installed with a gap having a certain space between a liner of a combustion chamber and the fuel nozzle block, and cooling air is made to flow toward the downstream of the liner of the combustion chamber from this gap, to thereby form a cooling-air layer on the inner surface of the liner of the combustion chamber.

In the above-mentioned combustor, cooling air is made to flow from the certain gap provided between the fuel nozzle block and the liner of the combustion chamber, to thereby form the cooling-air layer on the inner surface of the liner of the combustion chamber. Since the cooling air flows from this gap along the inner surface of the liner of the combustion chamber, the flow of the cooling air is hard to separate, and hence uniform cooling-air layer can be formed. Therefore, the liner of the combustion chamber can be reliably cooled, and combustion near the inner surface can be prevented to thereby suppress oscillating combustion. Further, since the gap is opened in the circumferential direction of the liner of the combustion chamber, the cooling-air layer is formed uniformly over the circumferential direction of the liner of the combustion chamber. As a result, combustion near the inner surface can be prevented over the circumferential direction of the liner of the combustion chamber, thereby occurrence of oscillating combustion can be reliably suppressed.

The combustor according to still another aspect of the present invention includes a cooling-air-layer forming ring to form a cooling-air layer toward the downstream of a liner of a combustion chamber, on the inner surface of the liner of the combustion chamber, with a certain gap between a fuel nozzle block and the liner of the combustion chamber of the combustor.

In the above-mentioned combustor, since the cooling-air-layer forming ring is provided between the liner of the combustion chamber and the fuel nozzle block, even when the fuel nozzle block deforms due to thermal expansion, a certain gap for forming the cooling-air layer can be maintained. Therefore, stable operation becomes possible, thereby improving the reliability of the combustor. Further, since the cooling-air-layer forming ring is protected from the high temperature combustion gas by the fuel nozzle block, the cooling-air-layer forming ring does not deform. Therefore, the gap formed between the cooling-air-layer forming ring and the liner of the combustion chamber is always kept at a certain interval, and hence even when the fuel nozzle block deforms during operation, the cooling-air layer is formed uniformly. As a result, the liner of the combustion chamber can be cooled stably, regardless of the operation time and operation condition of the gas turbine, and oscillating combustion can be suppressed.

The other objects, features, and advantages of the present invention are specifically set forth in or will become apparent from the following detailed descriptions of the invention when read in conjunction with the accompanying drawings.

BEST MODE FOR CARRYING OUT THE INVENTION

The present invention is explained in detail below with reference to the accompanying drawings. The present invention is not limited by the embodiments. The components in the embodiments include one that can be assumed easily by those skilled in the art. In the embodiments, a combustor of a premixed combustion method is explained as an example, but the combustor to which the present invention can be applied is not limited thereto.

Figure 1:
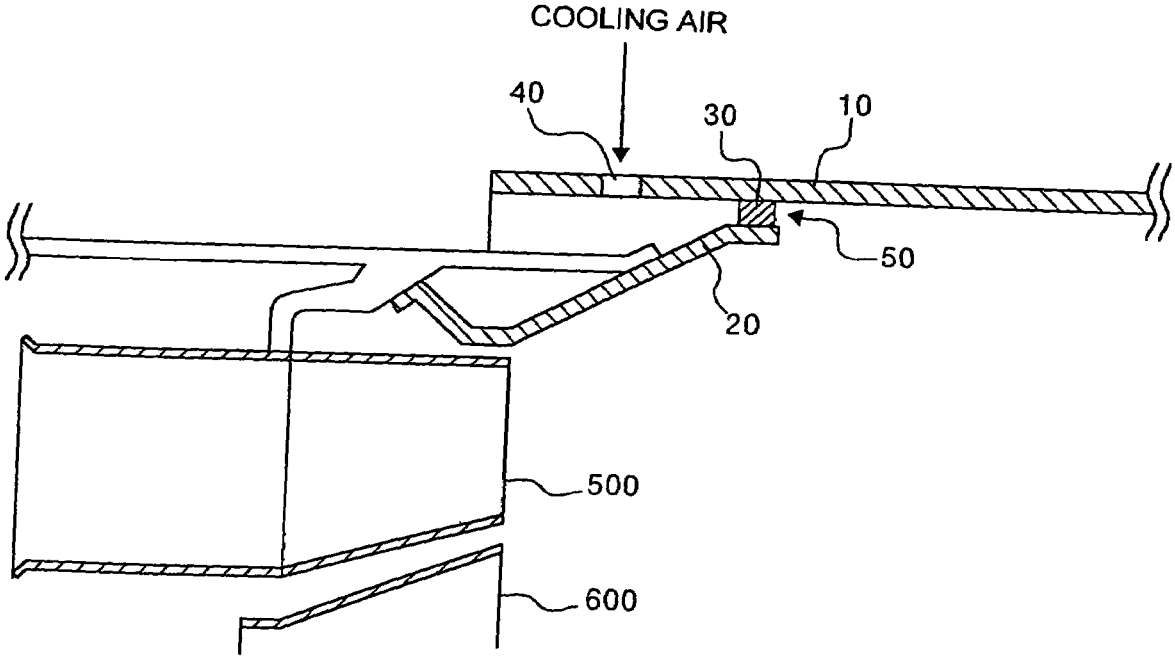
FIG. 1 is a cross-sectional view of a combustor according to a first embodiment of the present invention.

FIG. 1 is a cross-sectional view of a combustor according to the first embodiment of the present invention. This combustor has an arrangement to form a cooling-air layer from a fuel nozzle block toward the axial direction of the combustor, on the inner surface of the combustor. The fuel nozzle block 20 having therein a premixed flame forming nozzle 500 and a pilot cone 600 is inserted in the liner 10 of the combustion chamber. The premixed gas injected from the premixed flame forming nozzle 500 is ignited and burns by the diffusion flame formed by the pilot cone 600.

A plurality of spacers 30 are provided in the circumferential direction on the inner surface of the liner 10 of the combustion chamber. The arrangement to form a cooling-air layer between the fuel nozzle block 20 and the liner 10 of the combustion chamber, is a gap 50 formed between the fuel nozzle block 20 and inner surface of the liner 10 of the combustion chamber. The liner 10 of the combustion chamber is provided with a cooling-air supply hole 40 for feeding the cooling-air layer to the gap 50. The cooling air fed from this cooling-air supply hole 40 flows out from the gap 50, to form a cooling-air layer on the inner surface of the liner 10 of the combustion chamber. This cooling-air layer forms a temperature boundary layer between the high temperature combustion gas and the liner 10 of the combustion chamber, to thereby protect the liner 10 of the combustion chamber from the high temperature combustion gas.

According to the combustor in the first embodiment, since the cooling-air layer is formed on the inner surface of the liner 10 of the combustion chamber, the inner surface of the liner 10 of the combustion chamber is protected from the high temperature combustion gas. As a result, temperature rise in the liner 10 of the combustion chamber can be prevented, thereby extending the life of the liner 10 of the combustion chamber. Further, because of the presence of this cooling-air layer, sudden combustion does not occur near the inner surface, and as a result, oscillating combustion can be suppressed.

Figure 2:
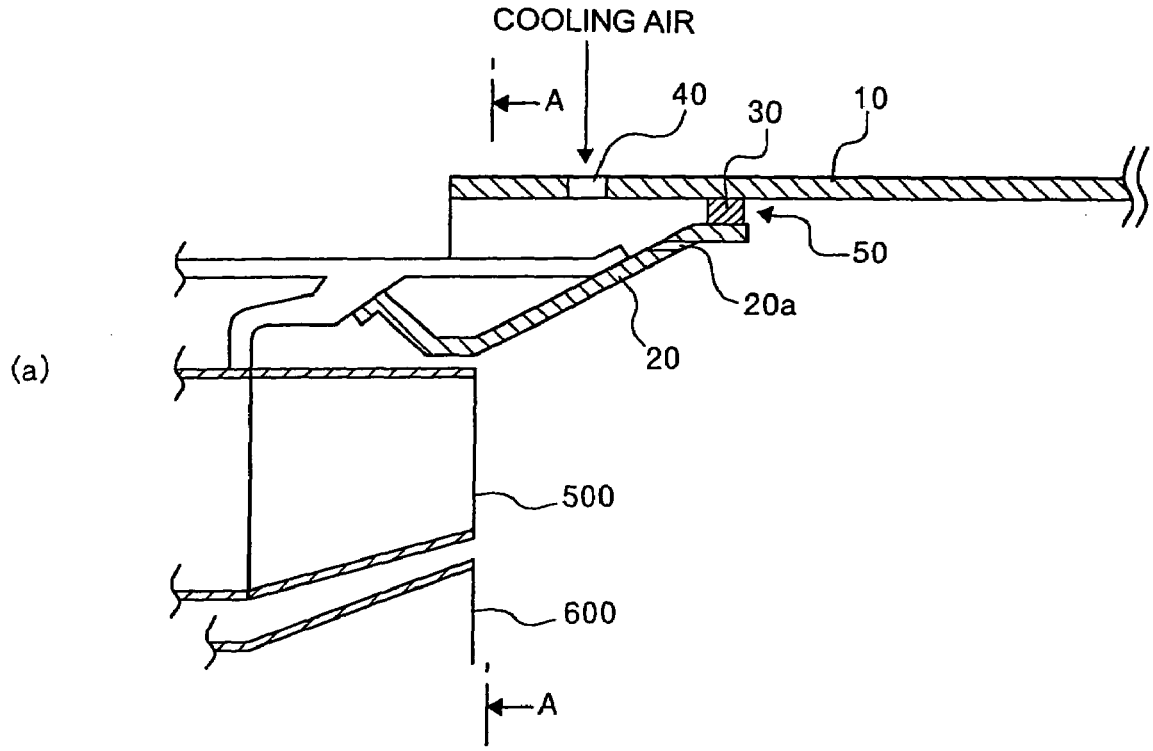
FIG. 2(*a*) and (*b*) illustrates modification of the combustor according to the first embodiment.
Figure 2:
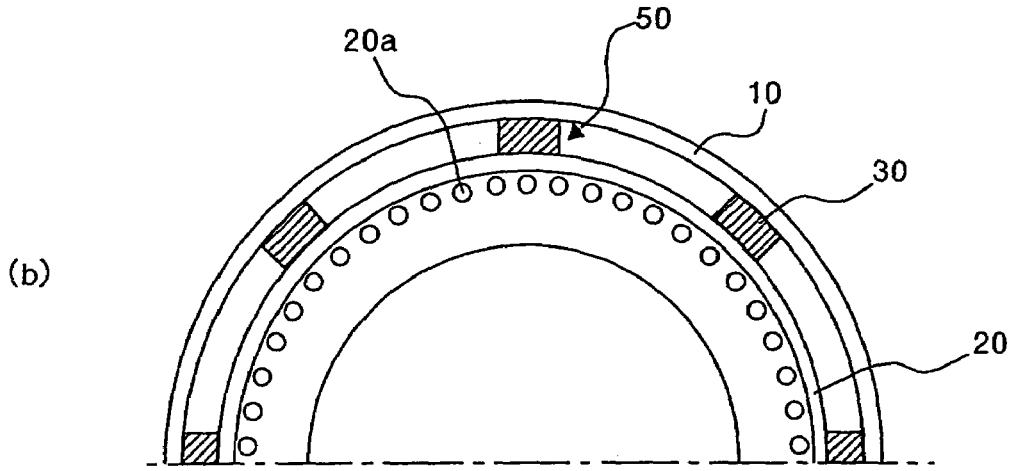

FIG. 2(*a*) is a cross-sectional view of a modification of the combustor of the first embodiment. FIG. 2(*b*) is a view of the combustor seen from the direction of arrow A—A in FIG. 2(*a*). In FIG. 2(*b*), the lower half has been omitted. This combustor has cooling-air supply holes 20*a* on the outer edge of the fuel nozzle block 20. As shown in FIG. 2(*b*), the cooling-air supply holes 20*a* near the periphery, that is, near the outer edge, of the fuel nozzle block 20. The cooling air is allowed to flow from the cooling-air supply holes 20*a* and the gap 50, to form the cooling-air layer on the inner surface of the liner 10 of the combustion chamber.

Figure 3:
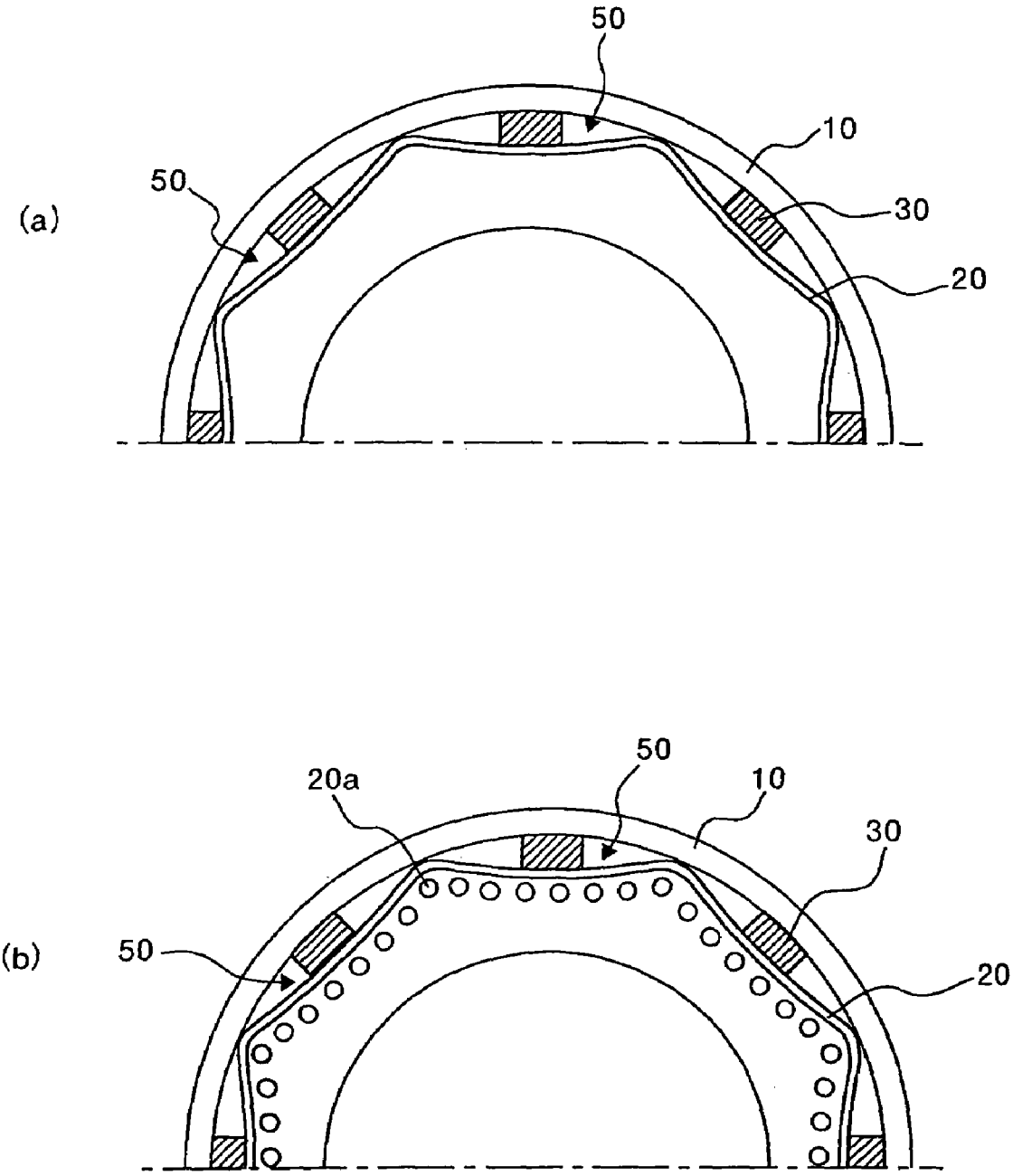
FIG. 3(*a*) and (*b*) illustrates a combustion nozzle block with the assumption that the gas turbine is operating.

FIG. 3 illustrates the combustion nozzle block when the gas turbine is operating. When the fuel nozzle block 20 thermally expands toward the inner surface of the liner 10 of the combustion chamber due to the high temperature combustion gas, thermal expansion is restricted at the portion where spacers 30 are provided, and hence the fuel nozzle block 20 deforms in a flower shape (FIG. 3(*a*)). As a result, as shown in FIG. 3(*a*), in a combustor having no cooling-air supply hole 20*a*, the interval of the gap 50 may become nonuniform. Hence, the cooling-air layer formed on the inner surface of the liner 10 of the combustion chamber becomes nonuniform as well.

However, as shown in FIG. 3(*b*), in the combustor according to this modified example, the cooling air is also supplied from the cooling-air supply holes 20*a* to the portion where the gap 50 is filled by the thermal deformation of the fuel nozzle block 20, and hence the cooling-air layer is formed on the inner surface of the liner 10 of the combustion chamber. In this manner, since the cooling-air layer can be formed on the inner surface of the liner 10 of the combustion chamber, regardless of the thermal expansion of the fuel nozzle block 20, the liner 10 of the combustion chamber can be always protected from the high temperature combustion gas, and oscillating combustion can be suppressed.

SECOND EMBODIMENT

In the combustor according to the first embodiment, when the fuel nozzle block moves radially due to some reasons during the operation, the size of the gap formed between the inner surface of the combustor and the fuel nozzle block becomes nonuniform. As a result, the thickness of the cooling-air layer formed on the inner surface of the combustor becomes also nonuniform, and hence cooling of the inner surface may be insufficient.

When the nozzle block thermally expands, a radial deformation is restricted at portions where the spacers exist. Therefore, the deforming behavior changes between the portions where the spacers exist and the portions where the spacers do not exist, and hence the shape of the nozzle block as seen from the front becomes a flower shape (FIG. 3(*a*)).

When the nozzle block deforms in such a shape, the interval of the gaps formed between the inner surface of the combustor and the fuel nozzle block becomes nonuniform, and the cooling-air layer formed on the inner surface of the combustor is not formed uniformly. As a result, cooling of the liner of the combustion chamber may be insufficient.

Figure 4:
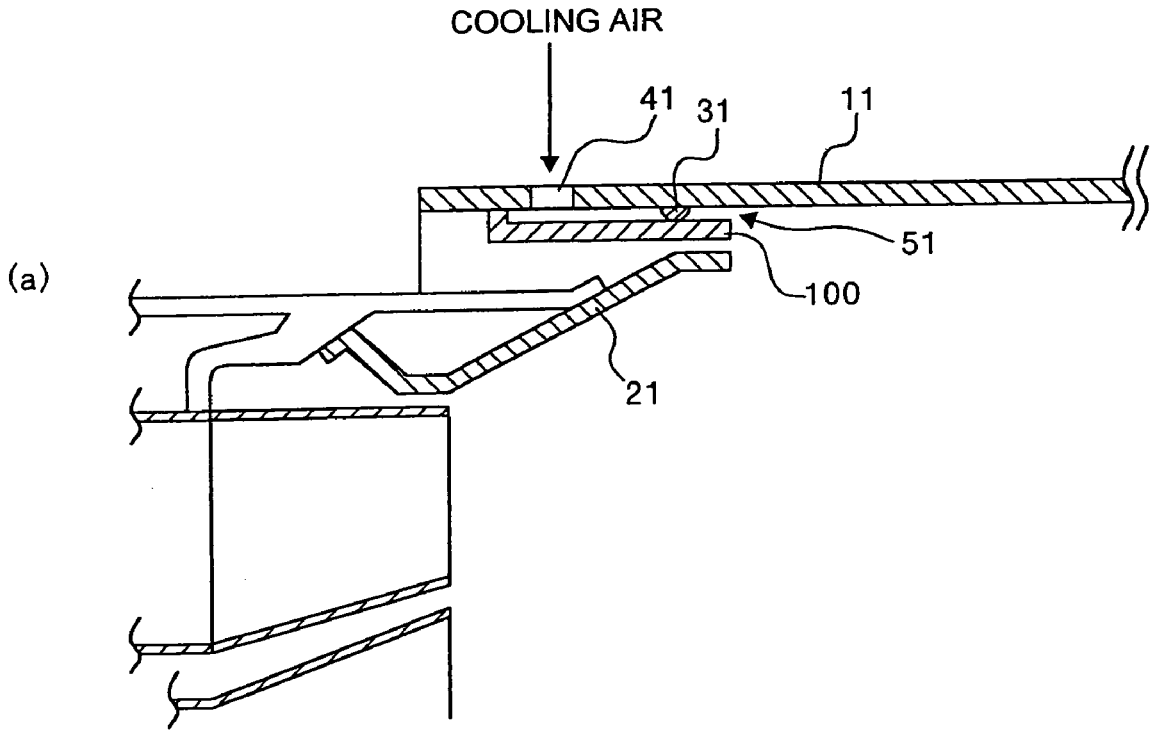
FIG. 4(*a*) and (*b*) is a cross-sectional view of a combustor according to a second embodiment of the present invention.
Figure 4:
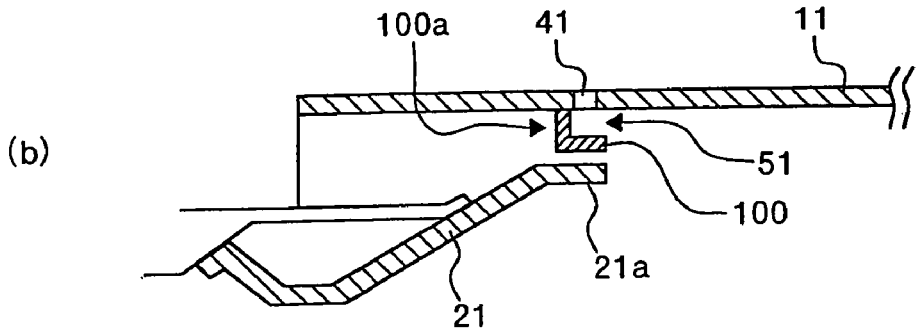

The combustor according to the second embodiment solves this problem of insufficient cooling of the liner. In this combustor, a cooling-air-layer forming ring is provided as an arrangement to form a cooling-air layer, with a certain space from the inner surface of the combustor. FIG. 4 is a cross-sectional view of the combustor according to the second embodiment of the present invention. A ring 100 is provided on the inner surface of the liner 11 of the combustion chamber, with a certain space from the inner surface by a spacer 31. This ring 100 can be fitted to the inner surface of the liner 11 of the combustion chamber, for example, by welding. When the strength of the ring 100 is sufficient, the spacer 31 may not be provided.

As shown in FIG. 4(*b*), a fringe area 21*a* of a fuel nozzle block 21 may be made to abut vertically against the side 100*a* of the ring 100 that is vertical to the wall surface of the liner 11 of the combustion chamber. In this manner, even when the fuel nozzle block 21*a* touches the ring 100 due to thermal expansion, a bending moment hardly acts on the side 100*a* of the ring 100, and hence a gap 51 formed between the ring 100 and the inner surface of the liner 11 of the combustion chamber does not collapse. By having such a structure, the gap 51 can be ensured without providing a spacer 31, and without increasing the strength of the ring 100 itself, or the strength at the attaching portion of the ring 100.

A cooling-air supply hole 41 is provided at the portion of the liner 11 of the combustion chamber where the ring 100 is attached, and the cooling air is supplied from here to the ring 100, during the operation of the gas turbine. The cooling air flows out from the gap 51 formed between the ring 100 and the inner surface of the liner 11 of the combustion chamber, to form a cooling-air layer on the inner surface of the liner 11 of the combustion chamber. Since this cooling-air layer forms a temperature boundary layer between the high temperature combustion gas and the liner 11 of the combustion chamber, the liner 11 of the combustion chamber is protected from the high temperature combustion gas. The fuel nozzle block 21 is inserted into the liner 11 of the combustion chamber, but at this time, the fuel nozzle block 21 is arranged inside of the ring 100 with a certain space. This certain space makes it easy to assemble the fuel nozzle block 21 in the liner 11 of the combustion chamber. The thermal deformation of the fuel nozzle block 21 can be allowed by this certain space. Further, since the fuel nozzle block 21 is cooled by the cooling air flowing from this certain space, thermal deformation of the fuel nozzle block 21 can be suppressed.

During the operation of the gas turbine, when the temperature of the fuel nozzle block 21 increases due to the high temperature combustion gas, the fuel nozzle block 21 thermally expands radially, and may touch the ring 100. In the combustor according to the second embodiment, even when the fuel nozzle block 21 touches the ring 100 due to the thermal expansion, the ring 100 does not deform, and hence the certain space can be maintained in the gap 51. Therefore, even when the fuel nozzle block 21 deforms during the operation of the gas turbine, the cooling air can be allowed to flow uniformly toward the inner surface of the liner 11 of the combustion chamber, and hence the cooling-air layer can be reliably formed. Further, since the combustion gas first strikes against the fuel nozzle block 21, and does not directly strike the ring 100, the temperature of the ring does not rise to a level causing a thermal deformation. As a result, the ring 100 does not deform during the operation of the gas turbine, and the space of the gap 51 formed by the ring 100 and the inner surface of the liner 11 of the combustion chamber can be kept constant.

According to the combustor in the second embodiment, even when the fuel nozzle block 21 deforms due to thermal expansion, the cooling-air layer can be reliably formed on the inner surface of the liner 11 of the combustion chamber. As a result, the liner 11 of the combustion chamber can be reliably cooled, regardless of the operation time and operation condition of the gas turbine, and oscillating combustion can be reliably suppressed, thereby enabling stable operation.

Figure 5:
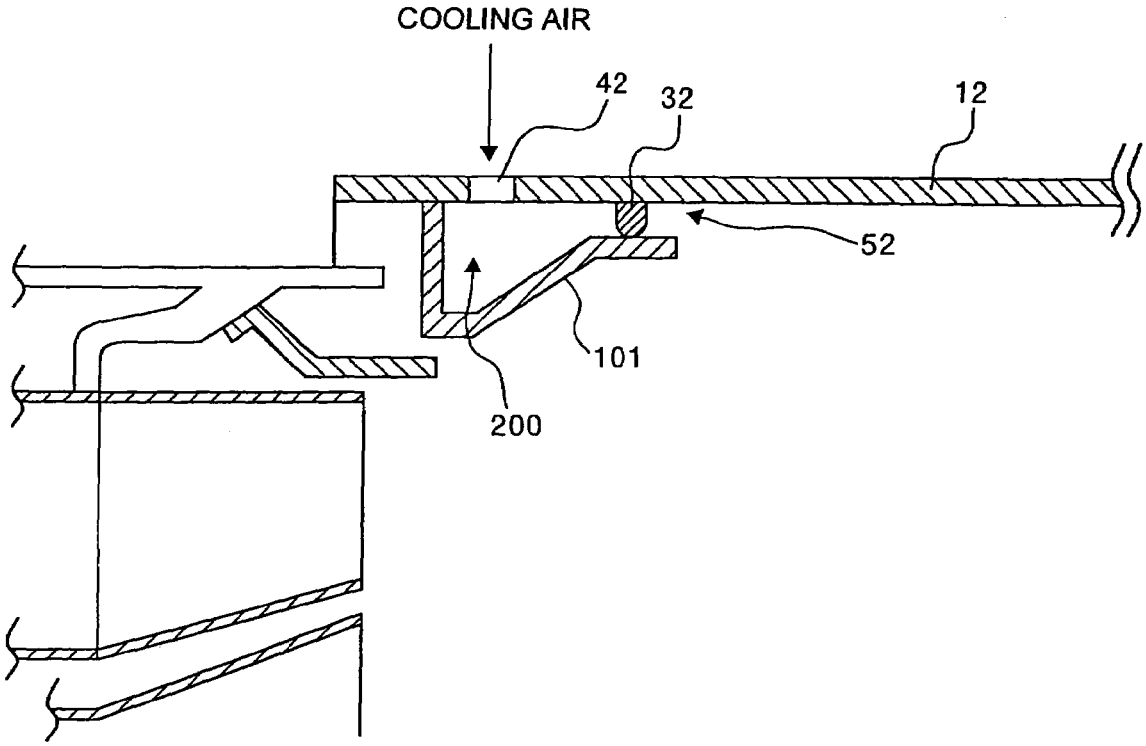
FIG. 5 is a cross-sectional view of a combustor according to a third embodiment of the present invention.

FIG. 5 is a cross-sectional view of a combustor according to a third embodiment of the present invention. This combustor has a manifold in the cooling-air-layer forming ring attached to the inner surface of the combustor. A ring 101 is attached to the inner surface of the liner 12 of the combustion chamber, and a gap 52 is formed between the inner surface and the ring 101 by a spacer 32. Cooling air is made to flow from this gap 52 toward the liner 12 of the combustion chamber, to form the cooling-air layer on the inner surface of the liner 12 of the combustion chamber.

A manifold 200 is provided in the ring 101, and cooling air supplied from a cooling-air supply hole 42 provided in the liner 12 of the combustion chamber is guided thereto. This cooling air is once accumulated in the manifold 200 and then allowed to flow toward the liner 12 of the combustion chamber, and hence the cooling air can be uniformly supplied to the circumferential direction. As a result, the cooling-air layer is stably formed on the inner surface of the liner 12 of the combustion chamber, and hence the liner 12 of the combustion chamber can be reliably protected from the high temperature combustion gas, and oscillating combustion can be stably suppressed.

Figure 6:
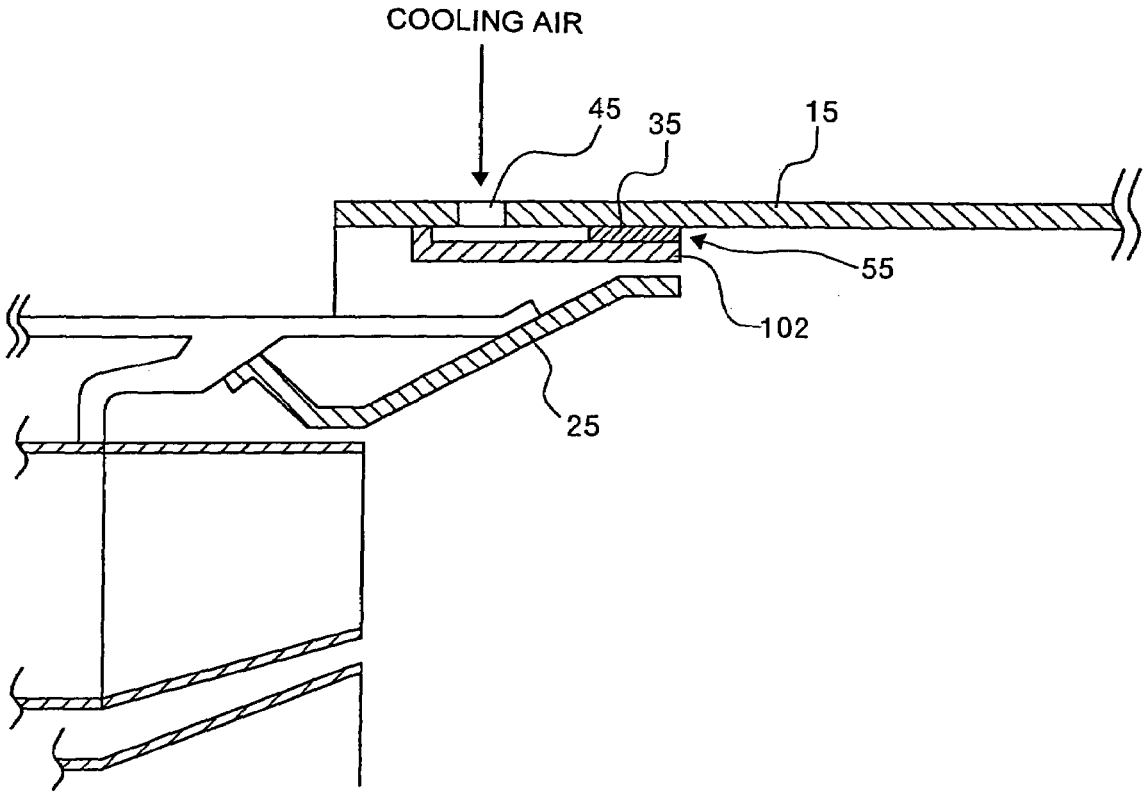
FIG. 6 is a cross-sectional view of a first example of a combustor according to a fourth embodiment of the present invention.
Figure 7:
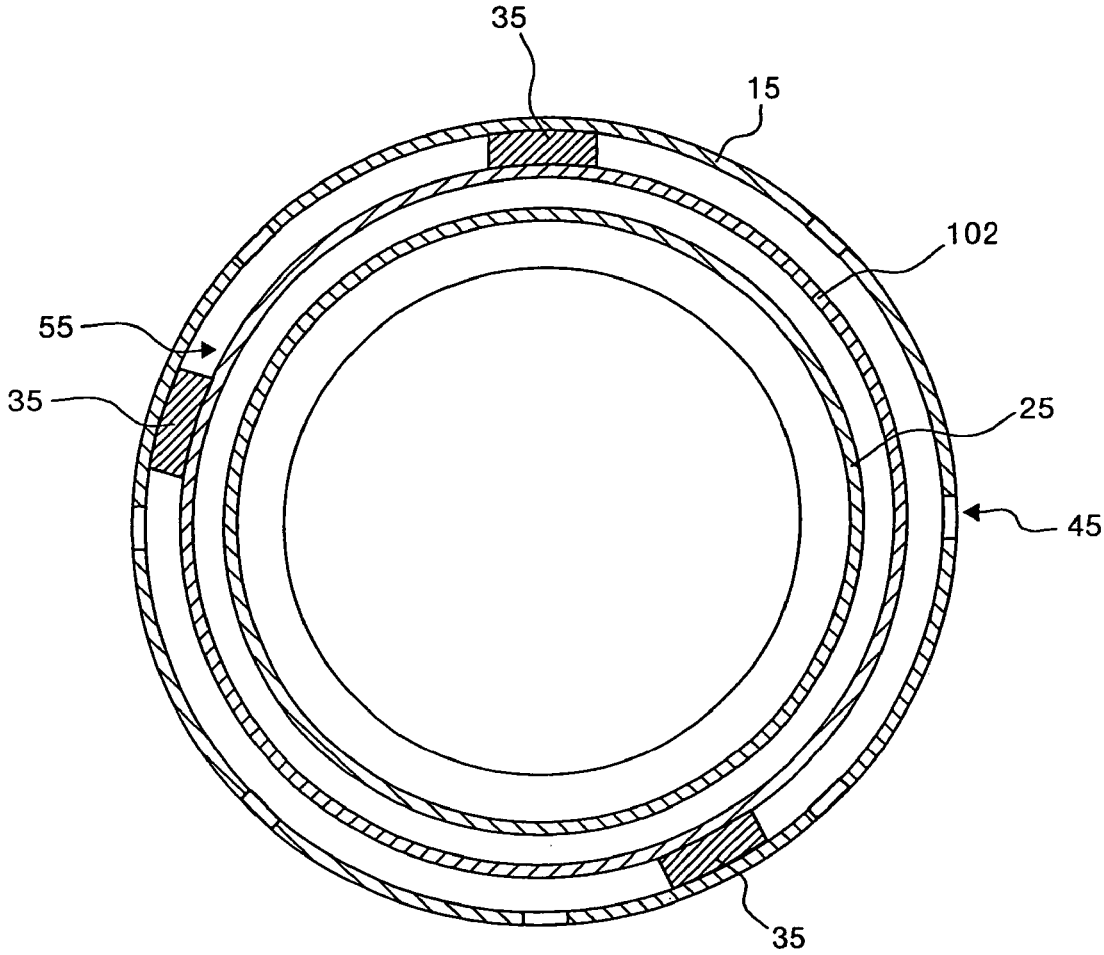
FIG. 7 is a front elevation of the combustor shown in FIG. 6.

FIG. 6 is a cross-sectional view of one example of the combustor according to a fourth embodiment of the present invention. FIG. 7 is a front elevation of the combustor shown in FIG. 6 (the premixing nozzle and the like are omitted). This combustor has a gap for supplying the cooling air formed between the liner of the combustion chamber and the ring forming the cooling-air layer, is filled by a filler member, to allow the combustion only on the slipstream side of the filler member, thereby form pressure antinodes, with the symmetric property thereof being destroyed, to thereby suppress the oscillating combustion.

Figure 8:
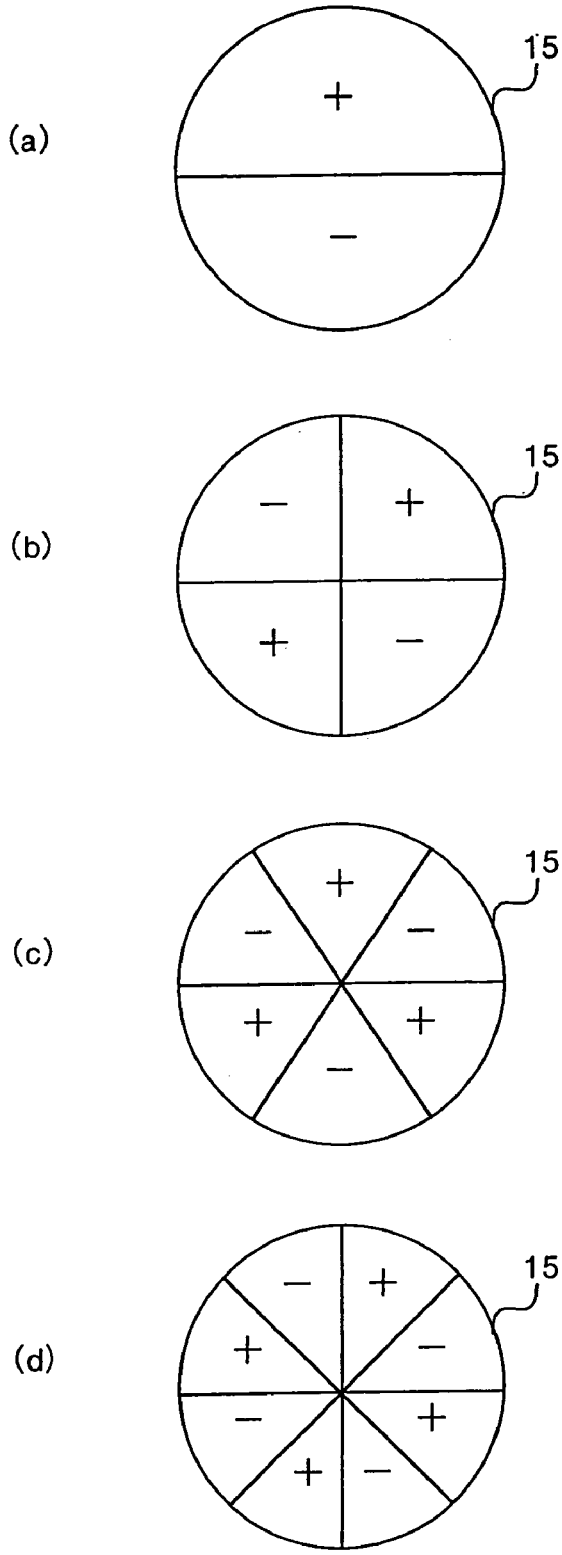
FIG. 8(*a*), (*b*), (*c*), and (*d*) is a conceptual diagram expressing the mode of a oscillational field when oscillating combustion occurs in a combustor.

FIG. 8 is a conceptual diagram expressing the mode of a oscillational field, when oscillating combustion occurs in the combustor. In the figure, "+" denotes antinodes of positive pressure, and "−" denotes antinodes of negative pressure. When sudden combustion occurs near the inner surface of the liner 15 of the combustion chamber, a sudden pressure change occurs, and as a result, the antinodes of positive pressure and the antinodes of negative pressure are alternately generated in any one mode shown in FIGS. 8(*a*) to 8(*d*), thereby causing oscillating combustion. In this manner, the pressure antinodes occur symmetrically at all times. Therefore, when combustion is made to occur near the inner surface of the liner 15 of the combustion chamber so as to destroy this symmetric property, the pressure antinodes irregularly occur in the circumferential direction of the liner 15 of the combustion chamber. As a result, the symmetric property is destroyed, thereby oscillating combustion hardly occurs.

As shown in FIG. 6 and FIG. 7, a ring 102 forming the cooling-air layer is inserted inside of the liner 15 of the combustion chamber, with a certain space from the inner surface of the liner 15 of the combustion chamber, to form a gap 55. A cooling-air supply hole 45 is also provided in the liner 15 of the combustion chamber, and the cooling air is supplied from here to the ring 102. As shown in FIG. 7, three filler members 35 are provided in the gap 55 with different intervals in the circumferential direction, to prevent the cooling air from passing through this portion.

When n filler members 35 are used, the intervals between the adjacent filler members 35 also exist in the number of n. At this time, when at least one interval is different from other intervals, the pressure antinodes irregularly occur in the circumferential direction of the liner 15 of the combustion chamber, and hence the symmetric property of the pressure antinodes can be destroyed. Further, when the number of filler members 35 increases too much, combustion occurs at the same time in portions where the filler members 35 are close to each other, and the pressure antinodes may be formed symmetrically. Therefore, the number of filler members is about 15 at most, and five to nine is preferable from the viewpoint of providing appropriate interval between the filler members 35 and of easy production.

Figure 9:
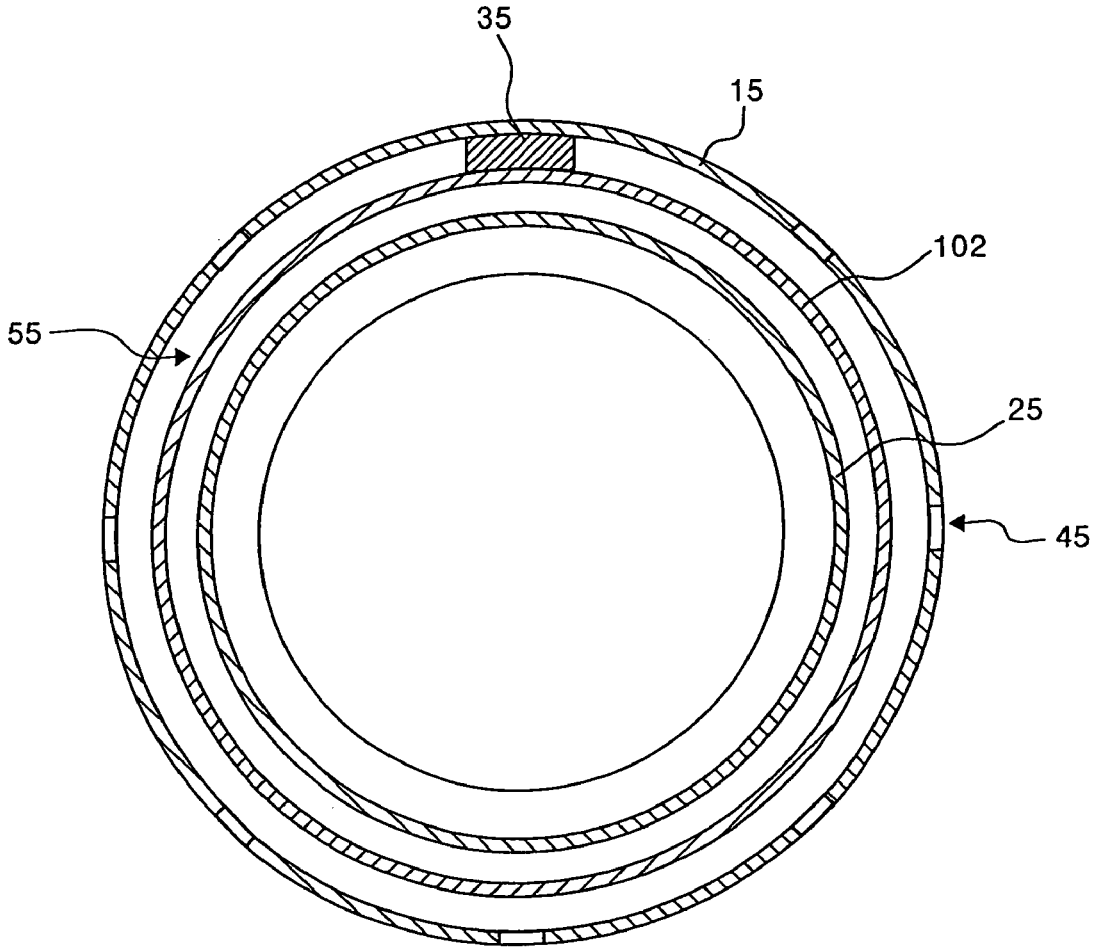
FIG. 9 is a front elevation of second example of the combustor according to the fourth embodiment.

Since the cooling air does not flow downstream of the filler members 35, the premixed gas burns near the inner surface of the liner 15 of the combustion chamber downstream of the filler members 35. However, combustion occurs near the inner surface of the liner 15 of the combustion chamber only downstream of the filler members 35, and the intervals of the burning spots are different in the circumferential direction. Therefore, the pressure antinodes irregularly occur in the circumferential direction of the liner 15 of the combustion chamber, to destroy the symmetric property of the pressure antinodes. As a result, since the mode of the oscillational field as shown in FIGS. 8(*a*) to 8(*d*) cannot be formed, oscillating combustion hardly occurs. In this example, three filler members 35 are provided, but as shown in FIG. 9, the number of the filler members 35 may be only one. It is because the mode of the oscillational field is formed due to the existence of a plurality of pressure antinodes, but when the pressure antinode is only one, the mode of the oscillational field cannot be formed, and hence oscillating combustion can be suppressed.

In this combustor, the area of the gap 55 decreases as compared with the case when the filler member 35 is not provided, and hence the cooling-air layer passing through the gap 55 can be decreased as compared with the case when the filler member 35 is not provided. Therefore, for example, even when the cooling-air layer cannot be formed over the circumferential direction of the liner 15 of the combustion chamber, since the cooling air that can be used for forming the cooling-air layer is little, oscillating combustion can be suppressed.

Figure 10:
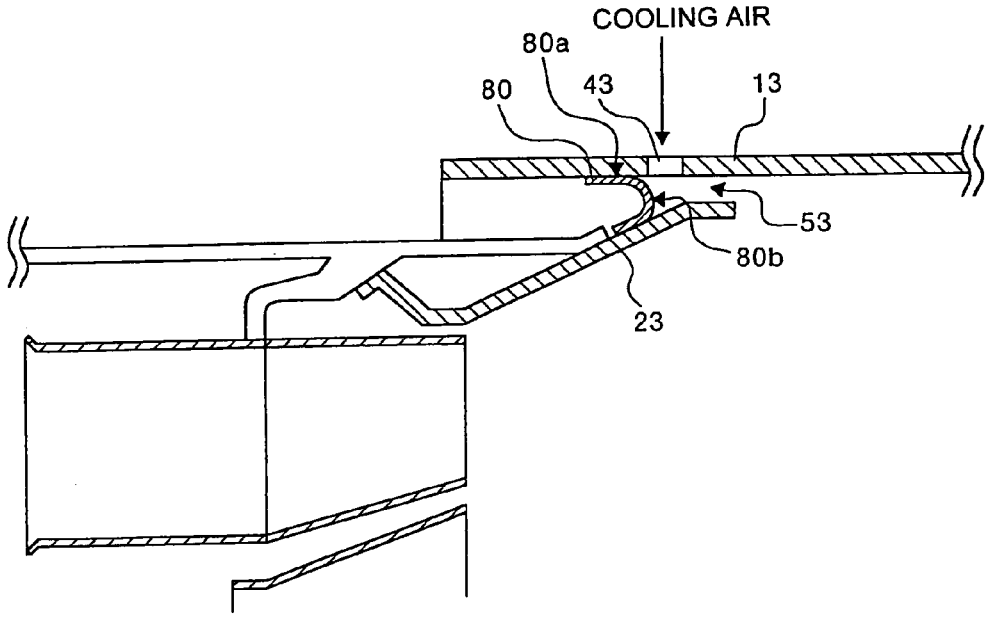
FIG. 10(*a*) and (*b*) is a cross-sectional view of a combustor according to a fifth embodiment of the present invention.
Figure 10:
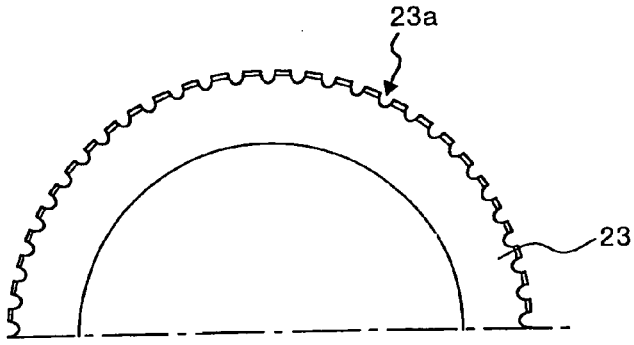

FIG. 10 is a cross-sectional view of a combustor according to a fifth embodiment of the present invention. This combustor is characterized in that the circumference of the end of the fuel nozzle block is formed as a spring structure, to give it a function of positioning between the fuel nozzle block and the liner of the combustion chamber, and a function of absorbing the thermal deformation of the fuel nozzle block, and a plurality of cooling-air supply holes are provided on the circumference, to form the cooling-air layer on the inner surface of the liner of the combustion chamber in the gas turbine.

A fuel nozzle block 23 is inserted into the liner 13 of the combustion chamber, with a certain gap 53 between the inner surface of the liner 13 of the combustion chamber and the fuel nozzle block. As shown in FIG. 10(*b*), a plurality of cooling-air supply holes 23*a* are provided toward the circumferential direction, on the outside edge of the fuel nozzle block 23. As in the fuel nozzle block 20 shown in FIG. 2(*b*), the cooling-air supply holes 23*a* may be formed by piercing the holes on the outside edge of the fuel nozzle block 23. However, it is desired to form the cooling-air supply holes in a shape with the outside edge side opened, as shown in FIG. 10(*b*), so that the cooling-air layer can be formed reliably, even when the fuel nozzle block 23 expands toward the inner surface of the liner 13 of the combustion chamber.

As shown in FIG. 10(*a*), an annular spacer 80 is fitted to the fuel nozzle block 23. The annular spacer 80 may be fitted to the fuel nozzle block 23 by welding or riveting, or may be formed integrally with the fuel nozzle block 23, so that when the end 80*a* of the annular spacer 80 touches the inner surface of the liner 13 of the combustion chamber, a curved portion 80*b* bends, to thereby keep the fuel nozzle block 23 at the center of the liner 13 of the combustion chamber. As shown in FIG. 10(*a*), since the annular spacer 80 comprises the curved portion 80*b*, even when the fuel nozzle block 23 thermally expands toward the inner surface of the liner 13 of the combustion chamber due to the high temperature combustion gas, the curved portion 80*b* of the annular spacer 80 bends therewith, and hence this thermal expansion can be absorbed. At this time, the position of the fuel nozzle block 23 can be kept at the center of the liner 13 of the combustion chamber, by a force directing toward the center of the liner 13 of the combustion chamber, which is generated due to bending of the curved portion 89*b* of annular spacer 80.

Figure 11:
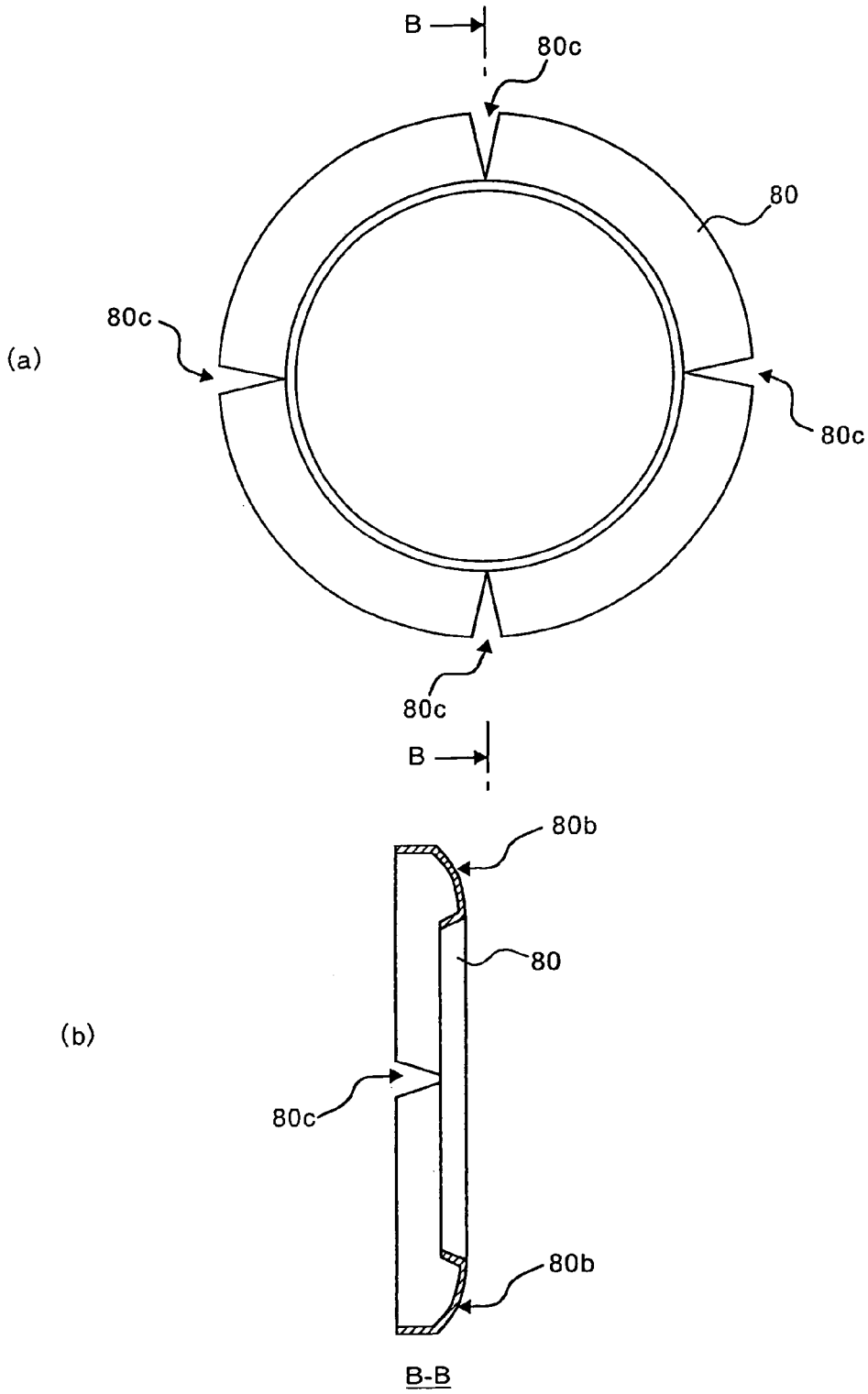
FIG. 11(*a*) and (*b*) illustrates a spacer used in the combustor according to the fifth embodiment.

Since the shape of the spacer 80 is annular, a force of compressing the annular spacer 80 in the circumferential direction acts when the curved portion 80*b* bends. In order to relax this force, and allow the annular spacer 80 to bend smoothly, as shown in FIGS. 11(*a*) and (*b*), the structure may be such that notches 80*c* are provided in the annular spacer 80, to divide the annular spacer 80 in the circumferential direction. Thereby, the force of compressing the annular spacer 80 in the circumferential direction, which is generated when the curved portion 80*b* of the annular spacer 80 bends, is absorbed because the notch 80*c* is narrowed. As a result, the thermal expansion of the fuel nozzle block 23 can be smoothly absorbed, making it easy to keep the fuel nozzle block 23 at the center of the liner 13 of the combustion chamber.

As shown in FIG. 10(*a*), a cooling-air supply hole 43 for supplying cooling air is provided in the body of the liner 13 of the combustion chamber. The cooling-air supply hole may be provided in the curved portion 80*b* of the annular spacer 80 to supply the cooling air therefrom, or the cooling air may be supplied by using the cooling-air supply hole together with the cooling-air supply hole 43 provided in the liner 13 of the combustion chamber. The cooling air supplied from the cooling-air supply hole 43 is guided to the space enclosed by the annular spacer 80, the fuel nozzle block 23 and the inner surface of the liner 13 of the combustion chamber. The cooling air is then supplied to the liner 13 of the combustion chamber from the gap 53 and the cooling-air supply holes 23*a* provided on the outside edge of the fuel nozzle block 23, to form the cooling-air layer on the inner surface of the liner 13 of the combustion chamber.

In this combustor, even when the fuel nozzle block 23 thermally expands due to the high temperature combustion gas, during the operation of the gas turbine, the curved portion 80*b* of the annular spacer 80 bends to keep the position of the fuel nozzle block 23 at the center of the liner 13 of the combustion chamber. Since the gap 53 becomes smaller in the circumferential direction as the fuel nozzle block 23 thermally expands, with a certain space being kept, the cooling-air layer formed on the inner surface of the liner 13 of the combustion chamber is not restricted.

Even when the fuel nozzle block 23 thermally expands, and the outside edge of the fuel nozzle block 23 come in contact with the inner surface of the liner 13 of the combustion chamber, the cooling air is supplied at all times from the cooling-air supply holes 23*a* provided in the outside edge, and hence the cooling-air layer is formed at all times on the inner surface of the liner 13 of the combustion chamber. The inner surface of the liner of the combustion chamber is protected from the high temperature combustion gas by this cooling-air layer, and sudden combustion hardly occurs near the wall surface, thereby suppressing oscillating combustion.

Figure 12:
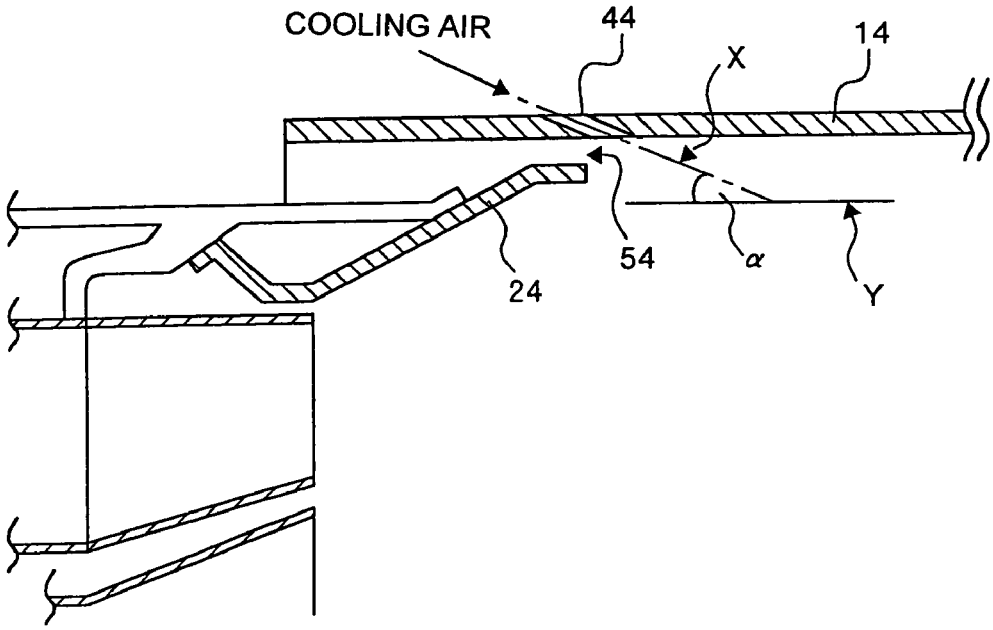
FIG. 12(*a*) and (*b*) is a cross-sectional view of a combustor according to a sixth embodiment.
Figure 12:
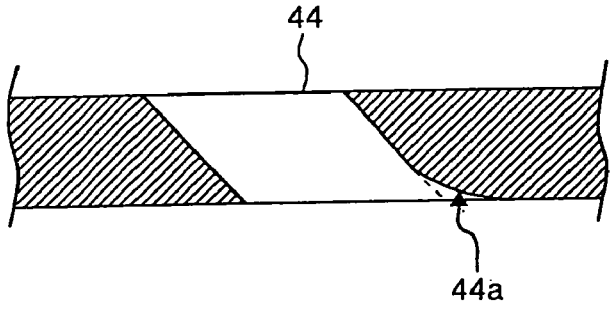
Figure 13:
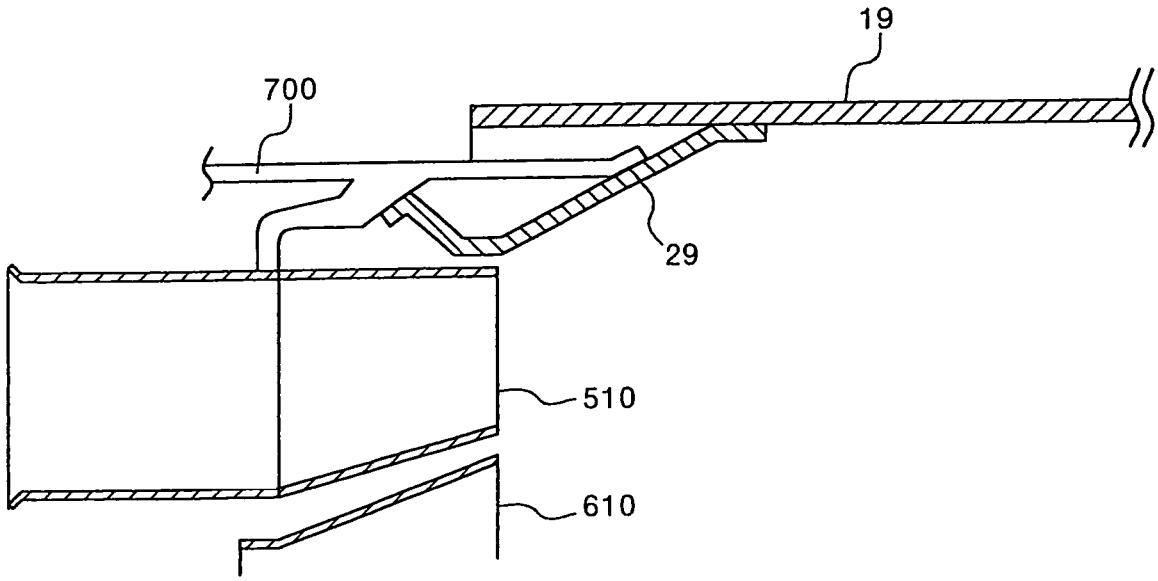
FIG. 13 is a cross-sectional view of a conventional premixing combustor.

FIG. 12 is a cross-sectional view of a combustor according to the sixth embodiment. This combustor has a cooling-air supply hole that obliquely pierces through the body of the liner of the combustion chamber. As a result, the cooling air flows from the cooling-air supply hole, thereby forming the cooling-air layer on the inner surface of the combustor 14 toward axially downstream of the combustor, immediately after the fuel nozzle block.

When an angle $\alpha$ between the central axis X of the cooling-air supply hole 44 and the axis Y of the liner 14 of the combustion chamber increases, a stagnation point in the cooling air flow occurs on the inner surface of the liner 14 of the combustion chamber, and hence the liner 14 of the combustion chamber may not be cooled sufficiently. Therefore, it is desired to decrease the angle $\alpha$ as small as possible, within the machinable range. Further, as shown in FIG. 12(*b*), an undercut 44*a* may be provided downstream of the outlet of the cooling air hole 44, so that the cooling-air layer does not separate.

In this combustor, the cooling-air supply hole 44 opens toward the inner surface of the liner 14 of the combustion chamber, downstream than the rear edge of the fuel nozzle block 24. Therefore, even when the fuel nozzle block 24 expands toward the inner surface of the liner 14 of the combustion chamber due to the high temperature combustion gas to fill the gap 54, the cooling-air layer is formed on the inner surface of the liner 14 of the combustion chamber by the cooling air supplied from the cooling-air supply hole 44. As a result, the inner surface of the liner 14 of the combustion chamber can be protected from the high temperature combustion gas, regardless of the deformation of the fuel nozzle block 24, and hence the life of the combustor 14 can be extended. Further, since the cooling-air layer is always formed on the inner surface of the liner 14 of the combustion chamber, sudden combustion hardly occurs near the inner surface. As a result, oscillating combustion is suppressed, enabling stable operation.

As explained above, in the combustor according to the present invention, the cooling-air layer is formed immediately after the nozzle block on the inner surface of the liner of the combustion chamber. As a result, combustion can be suppressed near the wall surface immediately after the nozzle block, where the concentration of the premixed gas is high. Thereby, oscillating combustion is suppressed, and the liner of the combustion chamber can be protected from the high temperature combustion gas.

In the combustor according to the next invention, cooling air is made to flow from a certain gap provided between the fuel nozzle block and the liner of the combustion chamber, to thereby form the cooling-air layer on the inner surface of the liner of the combustion chamber. Since the cooling air flows from this gap along the inner surface of the liner of the combustion chamber, the flow of the cooling air is hard to separate. Therefore, uniform cooling-air layer can be formed to reliably cool the liner of the combustion chamber, and hence combustion near the inner surface can be prevented to thereby suppress oscillating combustion. Further, since the certain gap is opened in the circumferential direction of the liner of the combustion chamber, combustion near the inner surface can be prevented over the circumferential direction of the liner of the combustion chamber, thereby occurrence of oscillating combustion can be reliably suppressed.

In the combustor according to the next invention, since the cooling-air-layer forming ring is provided between the liner of the combustion chamber and the fuel nozzle block, even when the fuel nozzle block deforms due to thermal expansion, a certain gap for allowing the cooling air to flow, that forms the cooling-air layer, can be maintained, thereby enabling stable operation. Further, since the cooling-air-layer forming ring is protected from the high temperature combustion gas by the fuel nozzle block, the cooling-air layer can be uniformly formed. As a result, oscillating combustion can be suppressed, and the liner of the combustion chamber can be cooled, regardless of the operation time and operation condition of the gas turbine.

In the combustor according to the next invention, since the manifold is provided upstream of the cooling-air-layer forming ring, pulsation of the cooling air is removed, to thereby stably supply the cooling air to the liner of the combustion chamber. As a result, since a pressure change in the combustion chamber and combustion near the inner surface of the liner of the combustion chamber resulting from the pulsation of the cooling air can be suppressed, to thereby reliably suppress oscillating combustion. Further, since the liner of the combustion chamber can be stably cooled, the life of the combustor can be extended.

In the combustor according to the next invention, since a certain gap is provided between the cooling-air-layer forming ring and the fuel nozzle block, even when the fuel nozzle block is thermally deformed, this gap becomes a margin for thermal expansion, to absorb the thermal deformation. As a result, the cooling-air layer can be formed stably, regardless of the operation time and operation condition of the gas turbine, to suppress oscillating combustion. Since the gap is provided, the work at the time of assembly of the fuel nozzle block into the liner of the combustion chamber becomes easy.

In the combustor according to the next invention, in the above combustor, a plurality of filler members are provided in the gap, with different intervals in the circumferential direction, to allow combustion immediately after the filler members, to thereby form the pressure antinodes irregularly in the circumferential direction of the liner of the combustion chamber. As a result, the occurrence of oscillating combustion is suppressed.

In the combustor according to the next invention, in the above combustor, the filler member is provided at one place in the gap, so as to destroy the symmetric property of the pressure antinodes to suppress oscillating combustion. Therefore, the area through which the cooling air passes becomes small due to the filler member, oscillating combustion can be suppressed, even when the amount of cooling air for forming the cooling-air layer cannot be ensured sufficiently.

INDUSTRIAL APPLICABILITY

As described above, the combustor according to the present invention is useful for the operation of the gas turbine, and is suitable for stably cooling the inner surface of the combustor, to operate the gas turbine stably, regardless of the operation time and operation condition of the gas turbine.

What is claimed is:

1. A combustor for a gas turbine, comprising:

a liner;

a combustion chamber formed within the liner, the chamber having an opening at an upstream side thereof a fuel nozzle block disposed within the opening of the chamber;

a ring for forming a cooling-air layer toward a downstream side with respect to the liner, wherein the ring is disposed between the liner and the fuel nozzle block with predetermined gaps for guiding the cooling-air toward the combustion chamber and forming the cooling-air layer on an inner surface of the liner; and a cooling-air supplying hole bored in the liner, wherein the hole is bored facing the ring;

wherein the ring is fixed to the inner surface of the liner at an upstream side of the cooling-air supplying hole.

2. The combustor according to claim 1, further comprising:

a plurality of spacers disposed circumferentially between the liner and the ring at predetermined intervals.

* * * * *